US009364087B1

(12) United States Patent
Sharperson

(10) Patent No.: US 9,364,087 B1
(45) Date of Patent: Jun. 14, 2016

(54) MULTI-PURPOSE TABLE

(71) Applicant: Michael Sharperson, Los Angeles, CA (US)
(72) Inventor: Michael Sharperson, Los Angeles, CA (US)

( * ) Notice: Subject to any disclaimer, the term of this patent is extended or adjusted under 35 U.S.C. 154(b) by 0 days.
(21) Appl. No.: 14/923,542
(22) Filed: Oct. 27, 2015
(51) Int. Cl.

| | |
|---|---|
| ***A47B 85/00*** | (2006.01) |
| ***A47B 85/06*** | (2006.01) |
| ***A47B 9/20*** | (2006.01) |
| ***A47B 13/00*** | (2006.01) |
| ***A47B 13/08*** | (2006.01) |
| ***A47G 33/06*** | (2006.01) |
| *A47B 9/00* | (2006.01) |

(52) U.S. Cl.
CPC . *A47B 85/06* (2013.01); *A47B 9/20* (2013.01); *A47B 13/003* (2013.01); *A47B 13/088* (2013.01); *A47G 33/06* (2013.01); *A47B 2009/006* (2013.01)
(58) Field of Classification Search
CPC ..... A47B 85/06; A47B 9/20; A47G 33/06
See application file for complete search history.

(56) References Cited

U.S. PATENT DOCUMENTS 1,049,668 A * 1/1913 Carlson ..... A47B 9/18 108/96
3,087,442 A 4/1963 Berliner
3,580,189 A * 5/1971 Eisenberg ..... A47B 85/06 108/161
3,674,612 A * 7/1972 Gehl ..... F21S 4/10 248/27.8
4,237,795 A 12/1980 Parker
4,259,909 A 4/1981 Belina
D269,771 S * 7/1983 Williams ..... D11/118
4,746,022 A * 5/1988 Benham ..... A47F 5/04 211/195
4,968,541 A * 11/1990 McCrory ..... A47G 33/1246 211/196
5,085,901 A * 2/1992 Johnson ..... A47G 33/06 211/196
5,363,772 A * 11/1994 Adamidis ..... A47B 9/00 108/66
5,975,317 A * 11/1999 Roebling ..... A47F 5/108 211/196
6,139,168 A * 10/2000 Gary ..... A47G 33/06 362/122
6,200,656 B1 * 3/2001 Tsang ..... A41G 1/007 428/12
6,374,755 B1 * 4/2002 Haase ..... A47G 19/00 108/101
6,550,728 B1 * 4/2003 Fuhrman ..... A47B 9/02 108/146
6,688,239 B1 * 2/2004 Pettini ..... A47B 7/02 108/50.11
7,089,878 B2 * 8/2006 Huang ..... E01F 9/0122 116/63 C
7,246,463 B1 * 7/2007 Arnot ..... A47G 33/1246 248/124.1
7,490,950 B1 * 2/2009 Meyers ..... A47G 33/06 362/123
D726,461 S 4/2015 Thorne
2003/0089287 A1 * 5/2003 Tseng ..... A47B 9/08 108/147.21
2008/0136296 A1 * 6/2008 Westbrook ..... A47B 9/20 312/194
2009/0289560 A1 * 11/2009 Oliva ..... A47G 33/06 315/185 S
2011/0076425 A1 * 3/2011 Cheng ..... A47G 33/06 428/8
2012/0304899 A1 * 12/2012 Kadosh ..... A47B 13/088 108/91
2013/0344303 A1 * 12/2013 Randall ..... A47B 85/06 428/201
2014/0339185 A1 * 11/2014 Ellison ..... A47F 5/04 211/119.03
2015/0083029 A1 * 3/2015 Pan ..... A47B 13/088 108/104

FOREIGN PATENT DOCUMENTS

CN 201790244 U 4/2011

* cited by examiner

*Primary Examiner* — Hanh V Tran
(74) *Attorney, Agent, or Firm* — Kyle A. Fletcher, Esq.

(57) ABSTRACT

The multi-purpose table is a table that is able to convert from a dinner table, to a cocktail table, to a Christmas tree. It shall be noted that the Christmas tree configuration for the multi-purpose table re-enacts a traditional Christmas tree. A pair of cross supports extends underneath a plurality of rings. A bottom ring surface of a lowest ring of the plurality of rings is also affixed to a plurality of telescoping legs. The plurality of telescoping legs is selectively attached to the lowest ring when in use as a cocktail table or a dining table.

20 Claims, 6 Drawing Sheets

FIG. 2
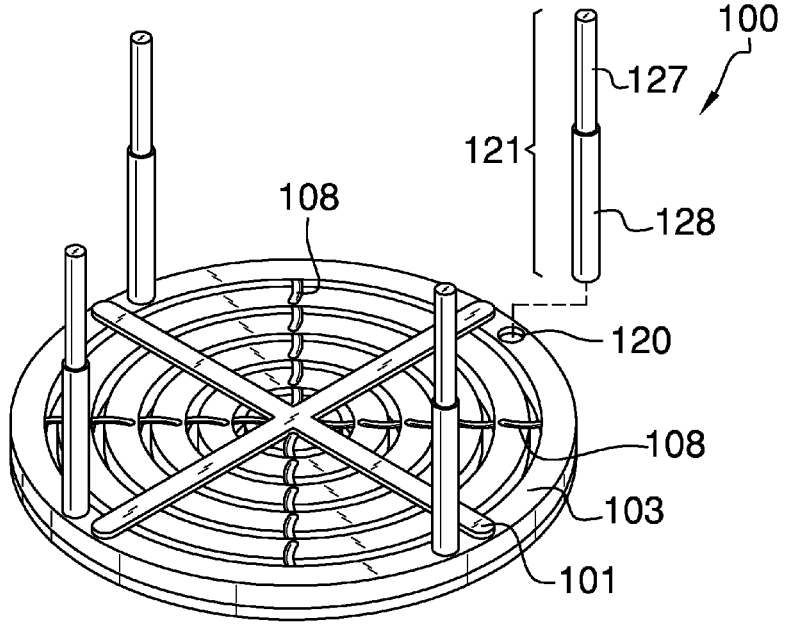
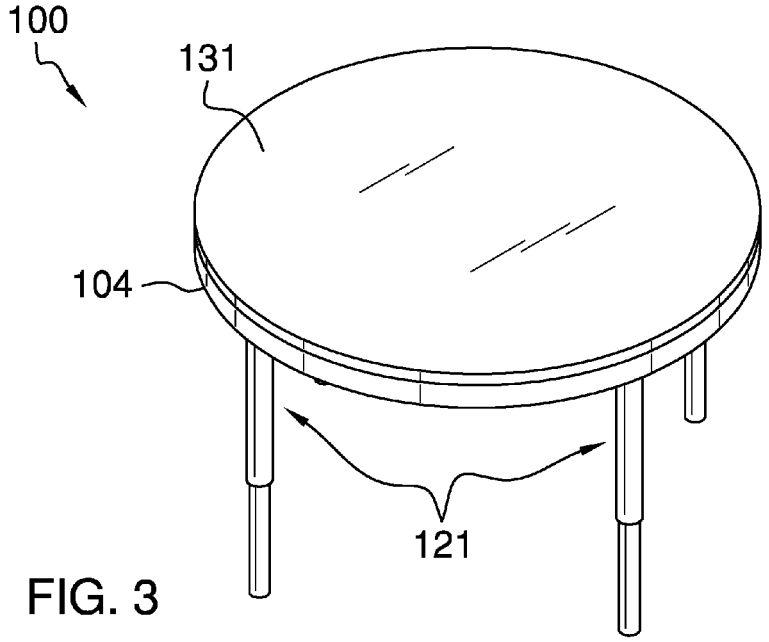
FIG. 3

FIG. 4
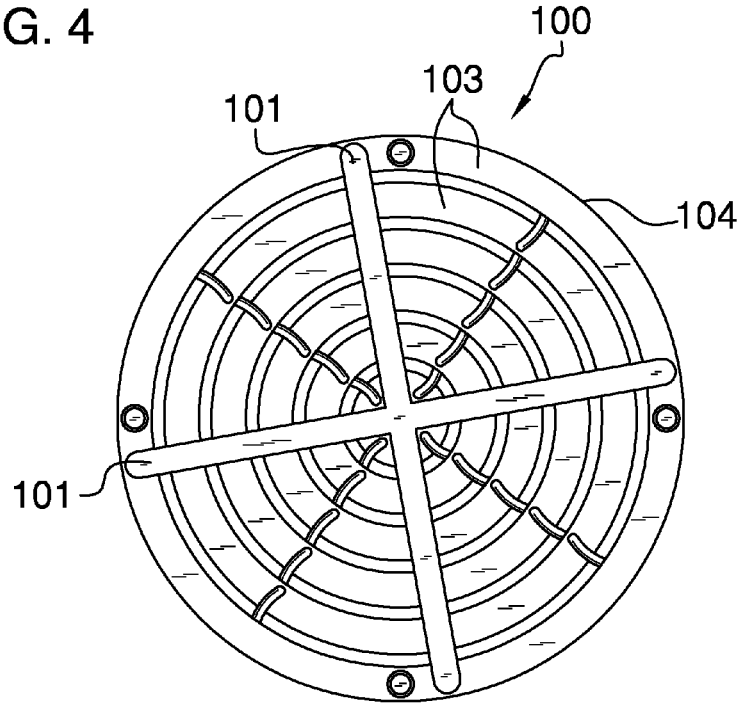
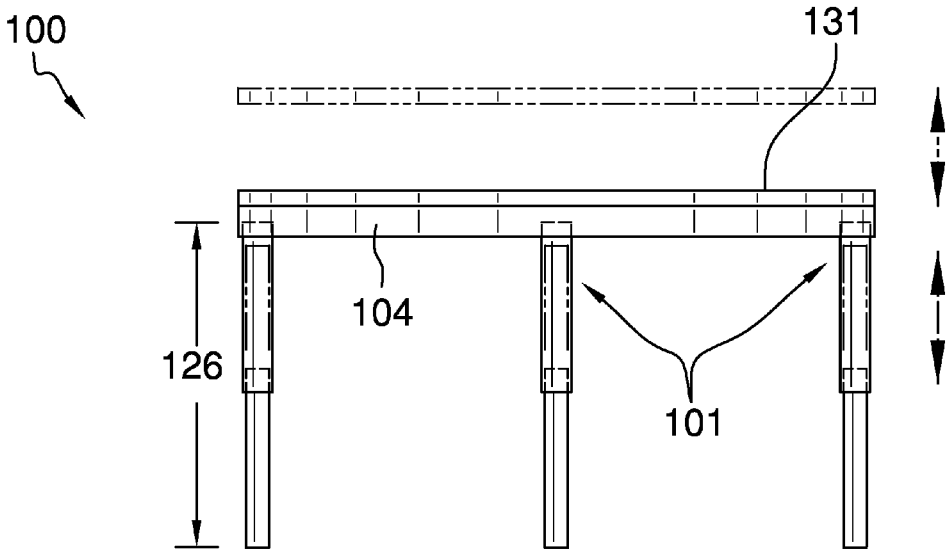
FIG. 5

MULTI-PURPOSE TABLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture, more specifically, a table that is able to transform into a Christmas tree.

SUMMARY OF INVENTION

The multi-purpose table is a table that is able to convert from a dinner table, to a cocktail table, to a Christmas tree. It shall be noted that the Christmas tree configuration for the multi-purpose table re-enacts a traditional Christmas tree. A pair of cross supports extends underneath a plurality of rings. A bottom ring surface of a lowest ring of the plurality of rings is also affixed to a plurality of telescoping legs. The plurality of telescoping legs is selectively attached to the lowest ring when in use as a cocktail table or a dining table. The pair of cross supports is also affixed to the bottom ring surface of the lowest ring. A plurality of intermediate rings and an uppermost ring are sequentially affixed to one another and the lowest ring. A table surface is selectively positioned atop of the lowest ring, the plurality of intermediate rings, and the topmost ring in order to form either a cocktail table or dining table. A stand is provided and extends upwardly and over top of the topmost ring such that the plurality of intermediate rings and the lowest ring extend down there from in order to form an overall shape of a Christmas tree. The lowest ring, the plurality of intermediate rings, and the topmost ring may include wiring and light receptacles such that a plurality of lights may be plugged into and illuminate the Christmas tree.

An object of the invention is to provide an item of furniture that converts from a dining table, a cocktail table, or a Christmas tree.

A further object of the invention is to provide a multi-purpose table that when converted to a Christmas tree shall enable lights to be plugged therein.

These together with additional objects, features and advantages of the multi-purpose table will be readily apparent to those of ordinary skill in the art upon reading the following detailed description of the presently preferred, but nonetheless illustrative, embodiments when taken in conjunction with the accompanying drawings.

In this respect, before explaining the current embodiments of the multi-purpose table in detail, it is to be understood that the multi-purpose table is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multi-purpose table.

It is therefore important that the claims be regarded as including such equivalent construction insofar as they do not depart from the spirit and scope of the multi-purpose table. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 2 is a bottom, perspective view of an embodiment of the disclosure.

FIG. 3 is a top, perspective view of an embodiment of the disclosure.

FIG. 4 is a bottom view of an embodiment of the disclosure.

FIG. 5 is a side view of an embodiment of the disclosure.

DETAILED DESCRIPTION OF THE EMBODIMENT

Figure 1:
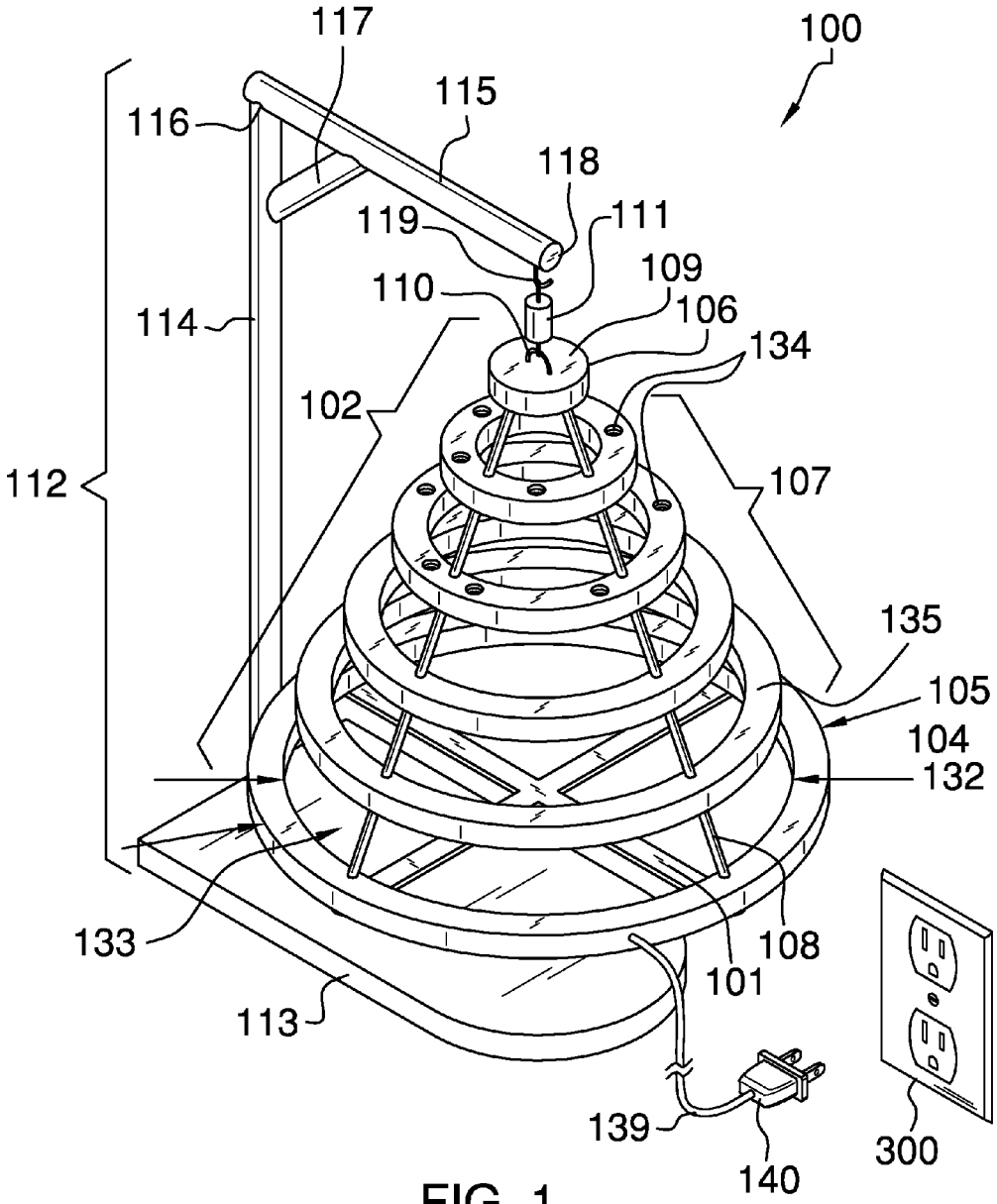
FIG. 1 is a perspective view of an embodiment of the disclosure.
Figure 6:
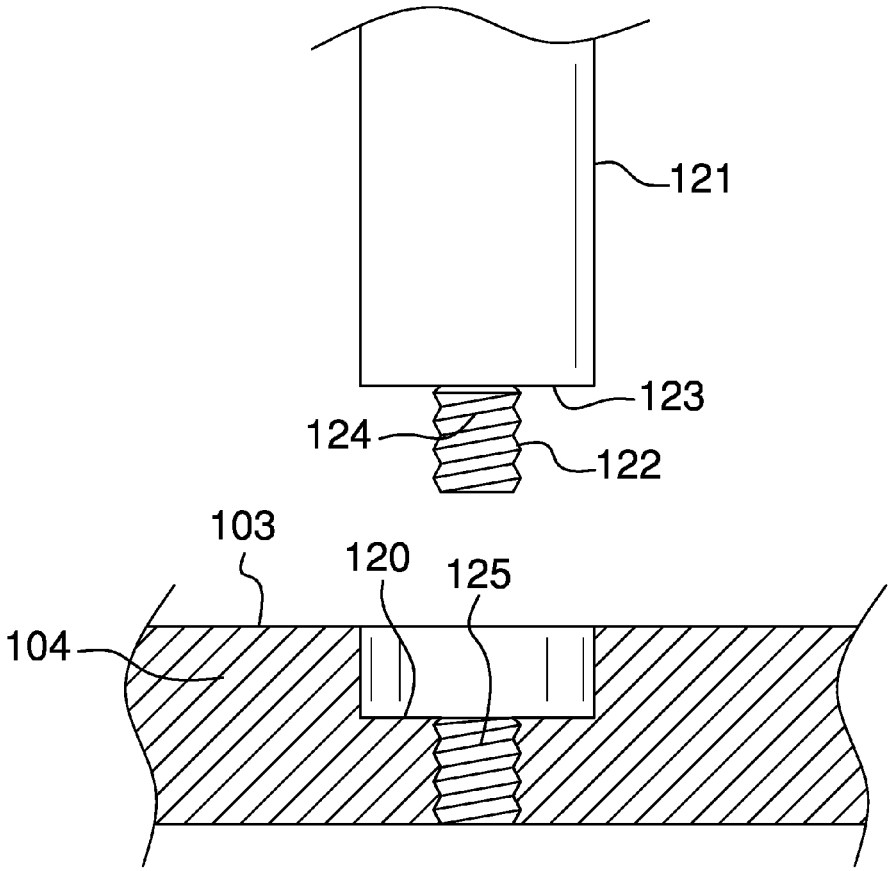
FIG. 6 is a detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 8. The multi-purpose table 100 (hereinafter invention) comprises a pair of cross supports 101 that extend underneath a plurality of rings 102. The pair of cross supports 101 attach to a bottom ring surface 103 of a lowest ring 104. The pair of cross supports 101 are perpendicular with respect to one another. The lowest ring 104 being the largest of the plurality of rings 102. More specifically, each of the plurality of rings 102 has a outer ring diameter 105. The outer ring diameter 105 of the lowest ring 104 is the largest of all of the plurality of rings 102.

The plurality of rings 102 are able to nest together such that lowest ring 104 has all remaining of the plurality of rings 102 nested therein. The outer ring diameter 105 of a topmost ring 106 is the smallest of all of the plurality of rings 102. Aside of the lowest ring 104 and the topmost ring 106, a plurality of intermediate rings 107 consumes the remaining of the plurality of rings 102.

At least one cord 108 attaches to the plurality of rings 102. Moreover, the at least one cord 108 is affixed sequentially from the lowest ring 104, to the intermediate rings 107, to the topmost ring 106. The at least one cord 108 enables the plurality of rings 102 to transform a nested state (see FIG. 2 or 4) to an erected orientation (see FIG. 1). It shall be noted that the plurality of rings 102 resembles a Christmas tree when in the erected orientation.

Referring to FIG. 1, the topmost ring 106 is further defined with a topmost surface 109. The topmost surface 109 includes a hook member 110 thereon. The hook member 110 enables a pinnacle member 111 to hook thereon. The pinnacle member 111 is also able to attach to a stand 112. The stand 112 includes a base 113 that supports a first vertical member 114. The first vertical member 114 attaches to a horizontal member 115 at a top end 116 of the first vertical member 114. A diagonal brace 117 may be included with the stand 112. The diagonal brace 117 attaches between the vertical member 114 and the horizontal member 115. The horizontal member 115 includes a distal end 118 that includes a stand hook 119 thereon. The pinnacle member 111 is selectively secured to the stand hook 119 in order to support the plurality of rings 102 in the erected orientation.

Referring to FIGS. 2 and 3, the invention 100 can transform from the erected orientation as a Christmas tree to a table. Moreover, use of the invention 100 as a table may vary depending on use. The invention 100 can transform from a cocktail table to a dinner table, and vice versa. The lowest ring 104 include leg recesses 120 on the bottom ring surface 103. The leg recesses 120 enable a plurality of telescoping legs 121 to be affixed to the lowest ring 104. Each of the plurality of legs 121 includes a threaded member 122 on a first leg end 123. The threaded member 122 has external threads 124 that correspond with a threaded hole 125 provided in each of the leg recesses 120 provided on the lowest ring 104. Each of the plurality of telescoping legs 121 is selectively secured to and removed from the lowest ring 104 (see FIG. 6).

Figure 7:
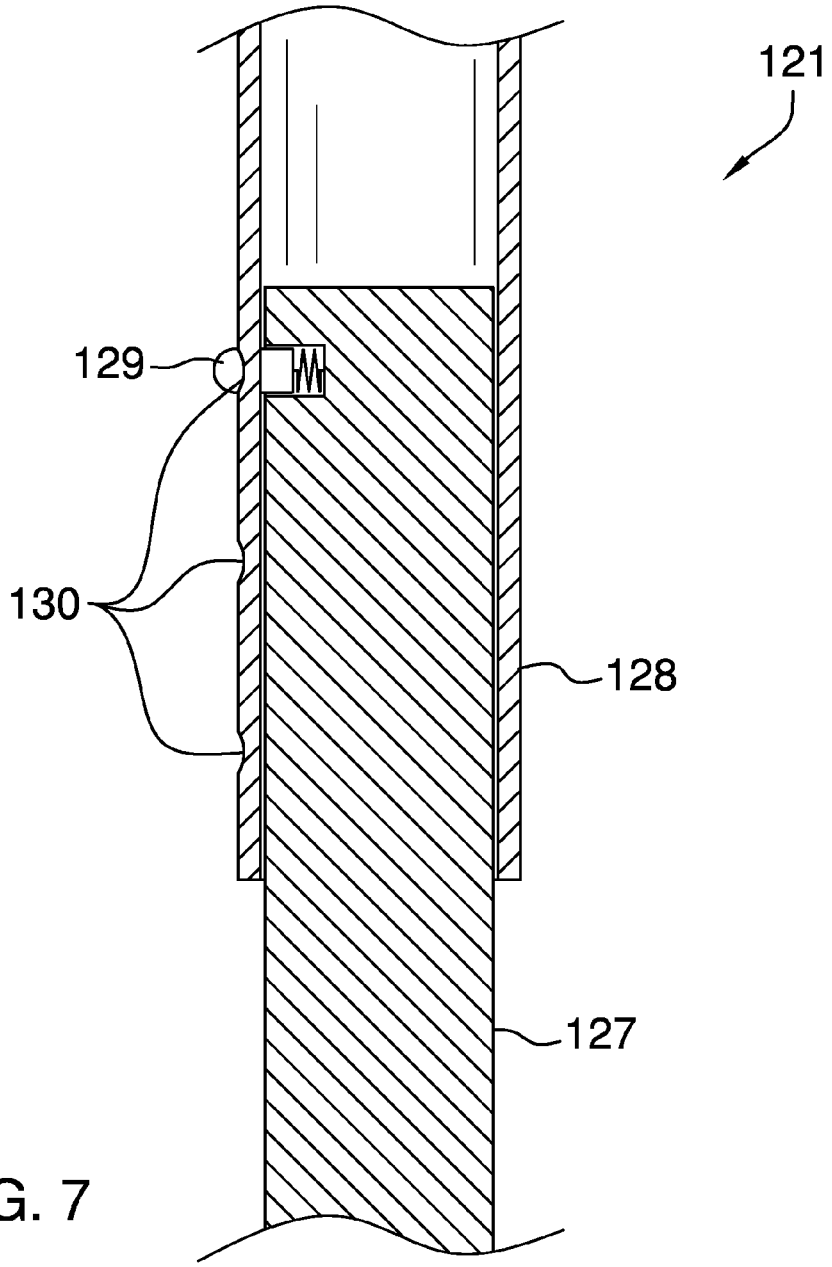
FIG. 7 is another detail view of an embodiment of the disclosure.
Figure 8:
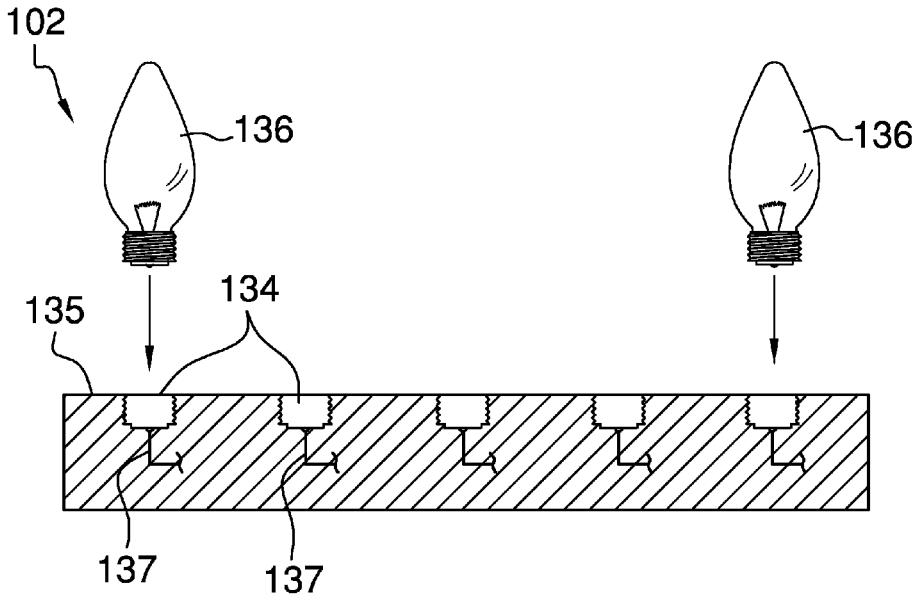
FIG. 8 is another detail view of an embodiment of the disclosure.

Referring to FIG. 7, each of the plurality of telescoping legs 121 is able to adjust a leg length 126. Each of the plurality of telescoping legs 121 is further defined with an inner leg member 127 that is able to extend and retract with respect to an outer leg member 128. A spring-loaded button 129 provided on the inner leg member 127 interfaces with one of a plurality of leg holes 130 provided on the outer leg member 128. Utilization of the spring-loaded button 129 with respect to the plurality of leg holes 130 enables adjustment of the leg length 126. The adjustment of the leg length 126 enables the invention 100 to be transformed from a cocktail table or a dinner table, or vice versa.

The invention 100 includes a tabletop 131. The tabletop 131 is positioned over the plurality of rings 102, provided the plurality of rings 102 is fully nested as depicted in FIG. 2. The tabletop 131 is essentially a disc-shaped member, which covers the plurality of rings 102 so that the invention 100 is able to be used as a cocktail table or as a dinner table. It shall be noted that the term cocktail table and the term dinner table are being used to loosely refer to a table that has a height typically associated with cocktail tables and dinner tables, respectively.

Each of the plurality of rings 102 is further defined with an inner ring diameter 132. The inner ring diameter 132 of the plurality of rings 102 shall correspond with the outer ring diameter 105. Moreover, the inner ring diameter 132 forms a ring opening 133 that enables the plurality of rings 102 to fully nest (see FIG. 2).

Optionally, the plurality of rings 102 may include a plurality of light sockets 134 on a top ring surface 135. The plurality of light sockets 134 are collectively wired to one another, and enable a plurality of light bulbs 136 to be plugged into the plurality of rings 102. When the plurality of rings 102 are in the erected orientation, the plurality of light bulbs 136 may be plugged into the plurality of light sockets 134 in order to illuminate the invention 100 in a manner analogous to a Christmas tree and Christmas tree lights. The plurality of light sockets 134 are wired to one another via a socket wire 137 that traverses around each of the plurality of rings 102. The at least one cord 108 enables electrical connectivity to be achieved amongst the plurality of rings 102. An electrical cord 139 extends from the invention 100. The electrical cord 139 includes an electrical plug 140 that is adapted to be plugged into a standard wall outlet 300 in order to derive electricity needed to power the plurality of light bulbs 136. It shall be noted that the plurality of light bulbs 136 may be halogen, incandescent, light emitting diode, fluorescent, or other lighting means.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A multi-purpose table comprising:

a plurality of rings that are in a nested arrangement with one another;

wherein the plurality of rings are attached to one another via at least one cord such that the plurality of rings is able to transform from a nested orientation to an erected orientation, and vice versa;

wherein the plurality of rings in said erected orientation resembles a Christmas tree;

wherein a plurality of telescoping legs is selectively attached to the plurality of rings in order to support the plurality of rings at a horizontal orientation;

wherein a tabletop is positioned atop of the plurality of legs in order to form a dinner table or a cocktail table.

2. The multi-purpose table according to claim 1 wherein a pair of cross supports extend underneath the plurality of rings.

3. The multi-purpose table according to claim 2 wherein the pair of cross supports attach to a bottom ring surface of a lowest ring.

4. The multi-purpose table according to claim 3 wherein the pair of cross supports are perpendicular with respect to one another.

5. The multi-purpose table according to claim 4 wherein the lowest ring being the largest of the plurality of rings.

6. The multi-purpose table according to claim 5 wherein each of the plurality of rings has an outer ring diameter;

wherein the outer ring diameter of the lowest ring is the largest of all of the plurality of rings.

7. The multi-purpose table according to claim 6 wherein the plurality of rings are able to nest together such that lowest ring has all remaining of the plurality of rings nested therein.

8. The multi-purpose table according to claim 7 wherein the outer ring diameter of a topmost ring is the smallest of all of the plurality of rings; wherein aside of the lowest ring and the topmost ring, a plurality of intermediate rings consumes the remaining of the plurality of rings.

9. The multi-purpose table according to claim 8 wherein the at least one cord is affixed sequentially from the lowest ring, to the intermediate rings, to the topmost ring; wherein the at least one cord enables the plurality of rings to transform a nested state to an erected orientation.

10. The multi-purpose table according to claim 9 wherein the topmost ring is further defined with a topmost surface; wherein the topmost surface includes a hook member thereon.

11. The multi-purpose table according to claim 10 wherein the hook member enables a pinnacle member to hook thereon; wherein the pinnacle member is also able to attach to a stand.

12. The multi-purpose table according to claim 11 wherein the stand includes a base that supports a first vertical member; wherein the first vertical member attaches to a horizontal member at a top end of the first vertical member.

13. The multi-purpose table according to claim 12 wherein a diagonal brace is included with the stand; wherein the diagonal brace attaches between the vertical member and the horizontal member.

14. The multi-purpose table according to claim 13 wherein the horizontal member includes a distal end that includes a stand hook thereon; wherein the pinnacle member is selectively secured to the stand hook in order to support the plurality of rings in the erected orientation.

15. The multi-purpose table according to claim 14 wherein the lowest ring includes leg recesses on the bottom ring surface; wherein the leg recesses enable the plurality of telescoping legs to be affixed to the lowest ring.

16. The multi-purpose table according to claim 15 wherein each of the plurality of legs includes a threaded member on a first leg end; wherein the threaded member has external threads that correspond with a threaded hole provided in each of the leg recesses provided on the lowest ring; wherein each of the plurality of telescoping legs is selectively secured to and removed from the lowest ring.

17. The multi-purpose table according to claim 16 wherein each of the plurality of telescoping legs is able to adjust a leg length; wherein each of the plurality of telescoping legs is further defined with an inner leg member that is able to extend and retract with respect to an outer leg member; wherein a spring-loaded button provided on the inner leg member interfaces with one of a plurality of leg holes provided on the outer leg member; wherein utilization of the spring-loaded button with respect to the plurality of leg holes enables adjustment of the leg length; wherein adjustment of the leg length enables the multi-purpose table to be transformed from a cocktail table or a dinner table, or vice versa.

18. The multi-purpose table according to claim 17 wherein each of the plurality of rings is further defined with an inner ring diameter; wherein the inner ring diameter of the plurality of rings corresponds with the outer ring diameter; wherein the inner ring diameter forms a ring opening that enables the plurality of rings to fully nest.

19. The multi-purpose table according to claim 18 wherein the plurality of rings include a plurality of light sockets on a top ring surface; wherein the plurality of light sockets are collectively wired to one another, and enable a plurality of light bulbs to be plugged into the plurality of rings; wherein when the plurality of rings are in the erected orientation, the plurality of light bulbs are plugged into the plurality of light sockets in order to illuminate the plurality of rings.

20. The multi-purpose table according to claim 19 wherein the plurality of light sockets are wired to one another via a socket wire that traverses around each of the plurality of rings; wherein the at least one cord enables electrical connectivity to be achieved amongst the plurality of rings; wherein an electrical cord extends from the plurality of rings; wherein the electrical cord includes an electrical plug that is adapted to be plugged into a standard wall outlet in order to derive electricity needed to power the plurality of light bulbs.

* * * * *